US005809711A

United States Patent [19]

Werner

[11] Patent Number: 5,809,711

[45] Date of Patent: Sep. 22, 1998

[54] APPARATUS AND METHOD FOR JOINING TWO PRESTRESSED CONCRETE ELEMENTS

[75] Inventor: Rolf J. Werner, Neumarkt, Germany

[73] Assignee: Pfleiderer Verkehrstechnik GmbH & Co. KG, Germany

[21] Appl. No.: 693,911

[22] Filed: Aug. 5, 1996

[30] Foreign Application Priority Data

Aug. 7, 1995 [DE] Germany ..... 195 28 999.4

[51] Int. Cl.[6] ..... C04H 5/00

[52] U.S. Cl. ..... 52/223.2

[58] Field of Search ..... 52/223.2, 223.13, 52/223.1, 223.3, 223.4, 223.5, 223.7, 223.9, 223.14

[56] References Cited

U.S. PATENT DOCUMENTS

| | | | |
|---|---|---|---|
| 1,579,285 | 4/1926 | Danaher et al. | 52/223.3 X |
| 2,571,578 | 10/1951 | Vander maelin | 52/223.3 X |
| 3,501,881 | 3/1970 | Van Buren | 52/223.4 |
| 3,520,968 | 7/1970 | Kreston | 52/273.1 X |
| 3,555,753 | 1/1971 | Magadini | 52/223.7 |
| 3,841,035 | 10/1974 | Amtmann et al. | 52/223.2 X |
| 3,869,530 | 3/1975 | Williams | 52/223.3 X |
| 3,893,270 | 7/1975 | Schupack et al. | 52/223.2 X |
| 3,897,619 | 8/1975 | Thivans | 52/223.14 X |
| 3,989,290 | 11/1976 | Aubert et al. | 52/223.2 X |
| 4,045,929 | 9/1977 | Velo Dalbrenta | 52/223.2 |
| 4,910,940 | 3/1990 | Grady, II | 52/223.5 X |
| 5,066,167 | 11/1991 | Siegfried et al. | 52/223.3 X |

FOREIGN PATENT DOCUMENTS

| | | |
|---|---|---|
| 306325 | 4/1973 | Australia . |
| A-330 832 | 7/1976 | Australia . |
| 1440024 | 4/1965 | France . |
| A-2 245 214 | 4/1975 | France . |
| 2545130 | 11/1984 | France . |
| A-2 546 930 | 12/1984 | France . |
| 1 178454 | 9/1964 | Germany . |
| B-12 69 152 | 5/1968 | Germany . |
| 1 280530 | 10/1968 | Germany . |
| A- 29 39 472 | 4/1981 | Germany . |
| 35 23 747A1 | 11/1987 | Germany . |
| 40 15 093C2 | 11/1991 | Germany . |

OTHER PUBLICATIONS von Dieter Jungwirth, "Korrosionsschutz im Spannbeton", Mabnahmen nd Systeme, Beton Dec. 1987, pp. 481–485 no translator.

Bouchon et al, "Le pont de la riviere Saint–Denis a la Reunion (Ocean Indien)", Travaux, Nr. 678 (1992), pp. 13–27 no translator.

Eibl et al, "Zwei Autobahnbrucken mit externer Vorspannung", Beton und Stahlbetonbau, Bd. 84 (1989), pp. 291–296, no translation.

*Primary Examiner*—Creighton Smith

*Attorney, Agent, or Firm*—Wolf, Greenfield & Sacks, P.C.

[57] ABSTRACT

In an apparatus for joining prestressed concrete elements, wherein two prestressed concrete elements to be joined comprise a first prestressed concrete element and a second prestressed concrete element, having a plurality of prestressed first strands within said first prestressed concrete element and a plurality of prestressed second strands within said second prestressed concrete element, a plurality of first strands, after emerging from said first prestressed concrete element, is introduced through openings into said second prestressed concrete element. These first strands introduced into said second prestressed concrete element are then fixed within said second prestressed concrete element under conditions of tensile stress. As a result, the two prestressed concrete elements arranged side by side and to be joined are securely joined together under conditions of predetermined compressive stress.

16 Claims, 5 Drawing Sheets

APPARATUS AND METHOD FOR JOINING TWO PRESTRESSED CONCRETE ELEMENTS

The invention is concerned with an apparatus for joining prestressed concrete elements according to the preamble of claim 1 and a method for joining prestressed concrete elements according to the preamble of claim 17.

Structures made of prestressed concrete elements, such as masts, towers or for example bridges, are erected by locally joining individual prestressed concrete elements together. Since production of prestressed concrete elements entails considerable outlay for equipment, these elements are manufactured in special production facilities, rather than being locally manufactured on the construction site. The subsequent transportation of the prefabricated prestressed concrete elements to the building site makes it necessary not to exceed predetermined maxima for the prestressed concrete element dimensions.

FIG. 4 is intended to explain a conventional apparatus for joining prestressed concrete elements.

FIG. 4 shows the area of abutment of two prestressed concrete pipes 110 and 120 shown in half-section. The prestressed concrete pipes are arranged in a circular symmetrical manner around axis 112. Prestressing wire strands 114 terminating in the area of a butt plate 130 run through both the prestressed concrete pipes. Butt plates 130 are made of metal and have conical bores in which prestressing wire strands 114 are secured by a wedge-type anchor 116. Bars 118 are respectively attached to butt plates 130, in particular they are butt-welded on to the plate.

The two butt plates 130 of two prestressed concrete pipes 110, 120, the end faces of which are adjacent, are aligned by centering pins 122 and the two butt plates are then bolted or welded together. Before the two prestressed concrete pipes are joined, the entire wedge-type anchor area 124 is cast in a suitable sealing material such as artificial resin so as to avoid damaging the prestressing wire strands as a result of moisture penetrating between butt plates 130.

A very large amount of top-quality metal in the form of butt plates 130 is required in this conventional connection of two prestressed concrete elements. There is also an interruption to the flow of force within the cross section of the prestressed concrete elements. The prestressing wire strands secured under conditions of prestress terminate in wedge-type anchors 116 of butt plates 130; the joint between the two butt plates is however fixed by the bolt connections through bores 126. In the depicted instance of a prestressed concrete pipe, this causes a radial shift in the flow of force through the connection of the two butt plates beyond the wall cross section of the prestressed concrete pipes.

The connecting joints between the individual prestressed concrete components, for instance in towers and masts which are erected by using such elements, are visible from afar and the thick protruding butt plates interrupt the otherwise slender outline.

It is therefore the problem (object) underlying the current invention to improve an apparatus and a method for joining prestressed concrete elements in such a manner that they are directly joined together without the use of thick-walled butt plates between the individual prestressed concrete elements, and so that an even flow of force is achieved within the area of abutment between two adjacent prestressed concrete elements.

This object is solved by an apparatus according to the features of claim 1 and in particular by the fact that a plurality of first strands running in a first prestressed concrete element can be introduced into a second prestressed concrete element after emerging from the first prestressed concrete element by means of openings and is fixable within the second prestressed concrete element under conditions of tensile stress.

The solution according to the invention results in a direct continuation of the prestressing wire strands running within a first prestressed concrete element—hereinafter referred to as short first strands—into a second prestressed concrete element which forms a joint with the first prestressed concrete element. The flow of force is guided constantly within the two adjacent prestressed concrete elements as a result of introducing the first strands emerging from a first prestressed concrete element into the second prestressed concrete element. An even flow of force can thus be achieved.

Since the first strands are fixable in the second prestressed concrete element in conditions of tensile stress, a continuous tensile stress can be achieved in the concrete structure to be erected while the individual prestressed concrete elements are assembled locally.

The invention's advantageous method for joining prestressed concrete elements is characterized in that the first strands emerging from the first prestressed concrete element are introduced into openings in the second prestressed concrete element, the two prestressed concrete elements to be joined are arranged side by side and the first strands are tensioned in the second prestressed concrete element.

According to an advantageous embodiment, the first strands enter tubular cavities in the second prestressed concrete element; these cavities are formed by jacket pipes. The first strands emerging from the first prestressed concrete element can simply be inserted into the second prestressed concrete elements as a result of molding the jacket pipes within the second prestressed concrete element. The jacket pipes also have the advantage that according to another advantageous embodiment of the invention, they can be filled with a filling material.

Using a filling material to fill the tubular cavities, particularly in the form of jacket pipes, has the advantage that the strands running inside the cavities can be protected from environmental effects. In this regard, the filling material may, according to a further advantageous embodiment of the invention, be a lubricant, though it may also be, according to another advantageous embodiment, a hardening material such as cement or lime milk.

When using a filling material in the form of a hardening material, the prestress of the first strands can, after injecting this hardening material into the tubular cavities and after the material has hardened, be absorbed and transmitted into the second prestressed concrete element.

According to a preferred embodiment, the first strands, after they have entered the second prestressed concrete element, have a bent trajectory. The provision of a bent trajectory is advantageous because the first strands terminate close to a wall of the second prestressed concrete element and from this point can be tensioned from the outside. This is necessary because a suitable holding fixture, such as a hydraulic press, has to be added and actuated from the outside.

The invention's apparatus for joining prestressed concrete elements can be advantageously used for joining prestressed concrete pipes, particularly spun concrete pipes. Depending on the wall thickness of the prestressed concrete pipes to be joined, the first strands entering a second prestressed concrete pipe from a first prestressed concrete pipe may run completely within the wall of the second prestressed concrete pipe or they can be guided along their course to an extent beyond the wall of the second prestressed concrete pipe.

The option of guiding the first strands to an extent beyond the second prestressed concrete element enables prestressed concrete elements, particularly prestressed concrete pipes, with a minimum wall thickness to be securely connected to one another.

According to a further embodiment of the invention, the first strands guided along their course to an extent beyond the wall of the second prestressed concrete pipe may, when prestressed concrete pipes are joined, pass through the outer surface, though they may also pass through the inner surface, of the second concrete pipe. Based on these various possibilities, there is considerable leeway in relation to the structure and design of the prestressed concrete elements to be joined.

The first strands fixable under conditions of tensile stress in the second prestressed concrete element advantageously terminate in an end anchor. Such an end anchor may accommodate, for example in a wedge-type anchor area, the first strands and may be securely fitted within the second prestressed concrete element before transportation to the erection site. The assembly work can thereby be considerably reduced and hence the assembly time shortened. When there is a defined predetermined length of the individual first strands and a fixed position of the end anchors, an even, preselected prestress of the first strands fixed within the end anchors belonging thereto is also achieved.

According to an advantageous embodiment, the connections between the first strands fixable under conditions of tensile stress and the end anchors belonging thereto are designed to be detachable and once a filling material has been filled into the tubular cavities, the end anchor is removable from the second prestressed concrete element. It is then possible to remove the end anchors when the filling material transmits the prestress force of the first strands to the second prestressed concrete element. It is then appropriate to remove the end anchors if they are to be re-used and the removal of the end anchors incurs lower costs than the use of respectively new end anchors.

According to a further embodiment of the apparatus according to the invention, the end anchors are secured close to a wall of the prestressed concrete element and are accessible through a prestressing chamber molded inside the prestressed concrete element. The first strands can, as a result, be tensioned in a convenient manner, though it is also possible to remove the end anchors after an injected filling material has hardened.

According to a preferred embodiment, a helical spring close to the end anchor is respectively arranged around the first strands. On account of the advantageously bent trajectory of the first strands, components of force are produced in two different directions within the prestressed concrete element, with a radial force component being present in the case of prestressed concrete pipes. This force component, which does not run along the prestressing wire strands cast within the prestressed concrete element, is damped by the helical spring which reduces the explosive effect of this force component.

The advantageous method for joining prestressed concrete elements is characterized by the characterizing features of claim 17. According to a further preferred embodiment of the invention, the prestressing chambers are sealed after the filling material has been injected. The first strands which terminate in the prestressed elements or which have uncovered ends after the prestressed elements have been removed are thereby protected from environmental effects. The prestressing chambers which may, in the case of a prestressed concrete element, be visible from the outside are also eliminated and a smooth external surface of the prestressed concrete element is achieved.

Three embodiments of the present invention will be described in the following purely by way of example with reference to the enclosed drawings.

Figure 1:
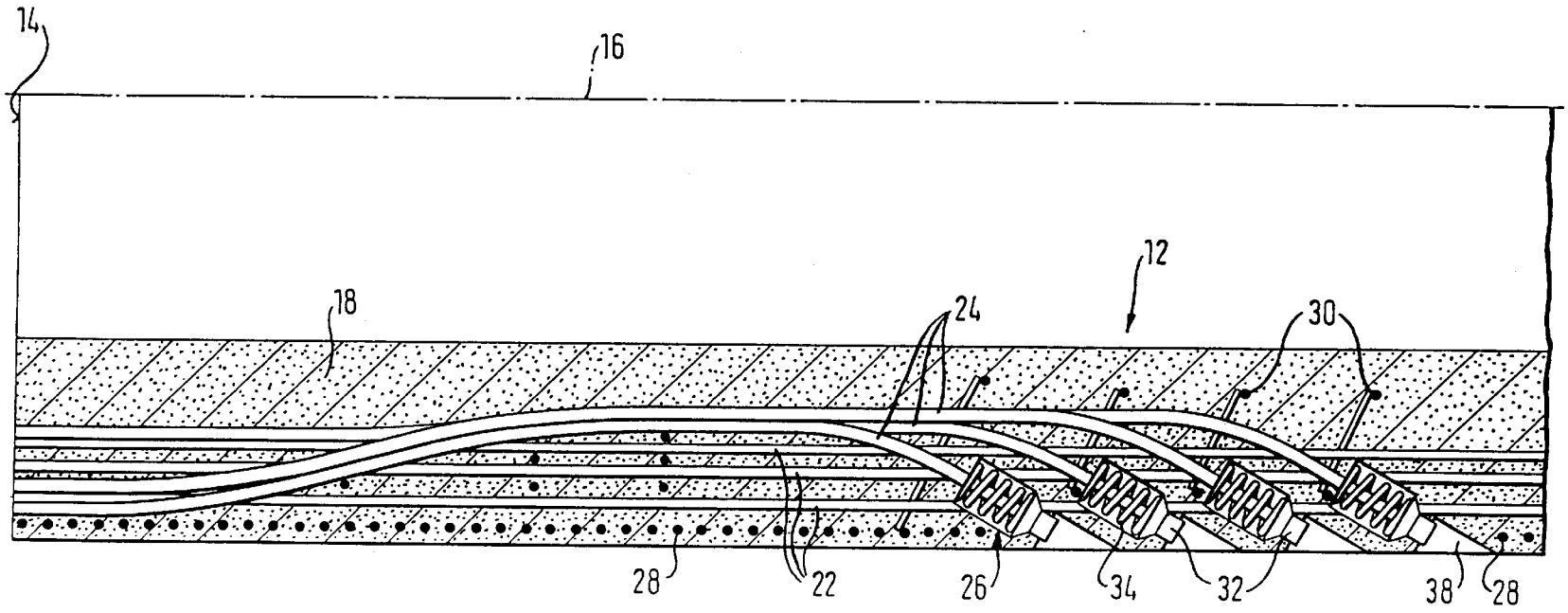
FIG. 1 shows a cross section through a jacket pipe layout according to the invention.
Figure 3:
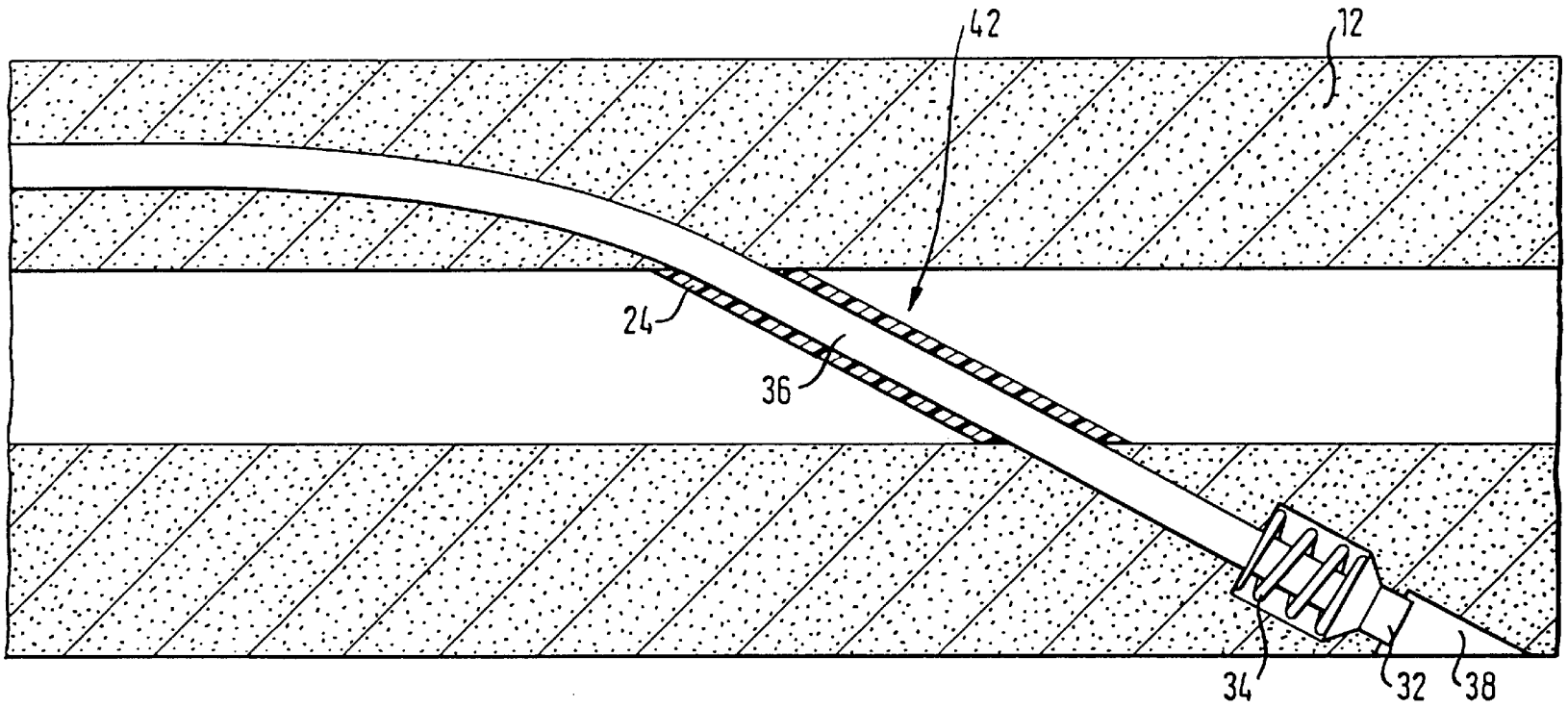
Figure 4:
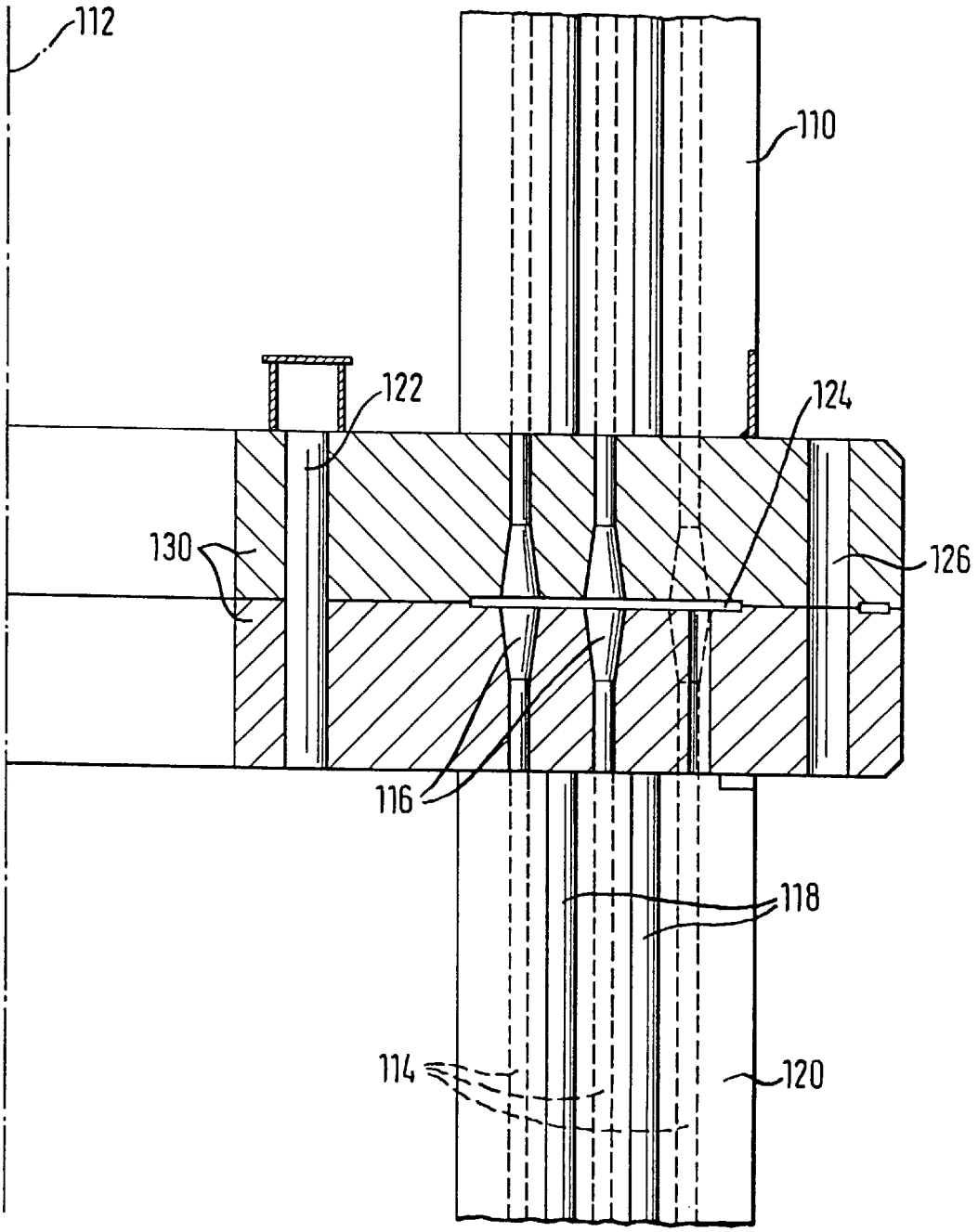
Figure 5:
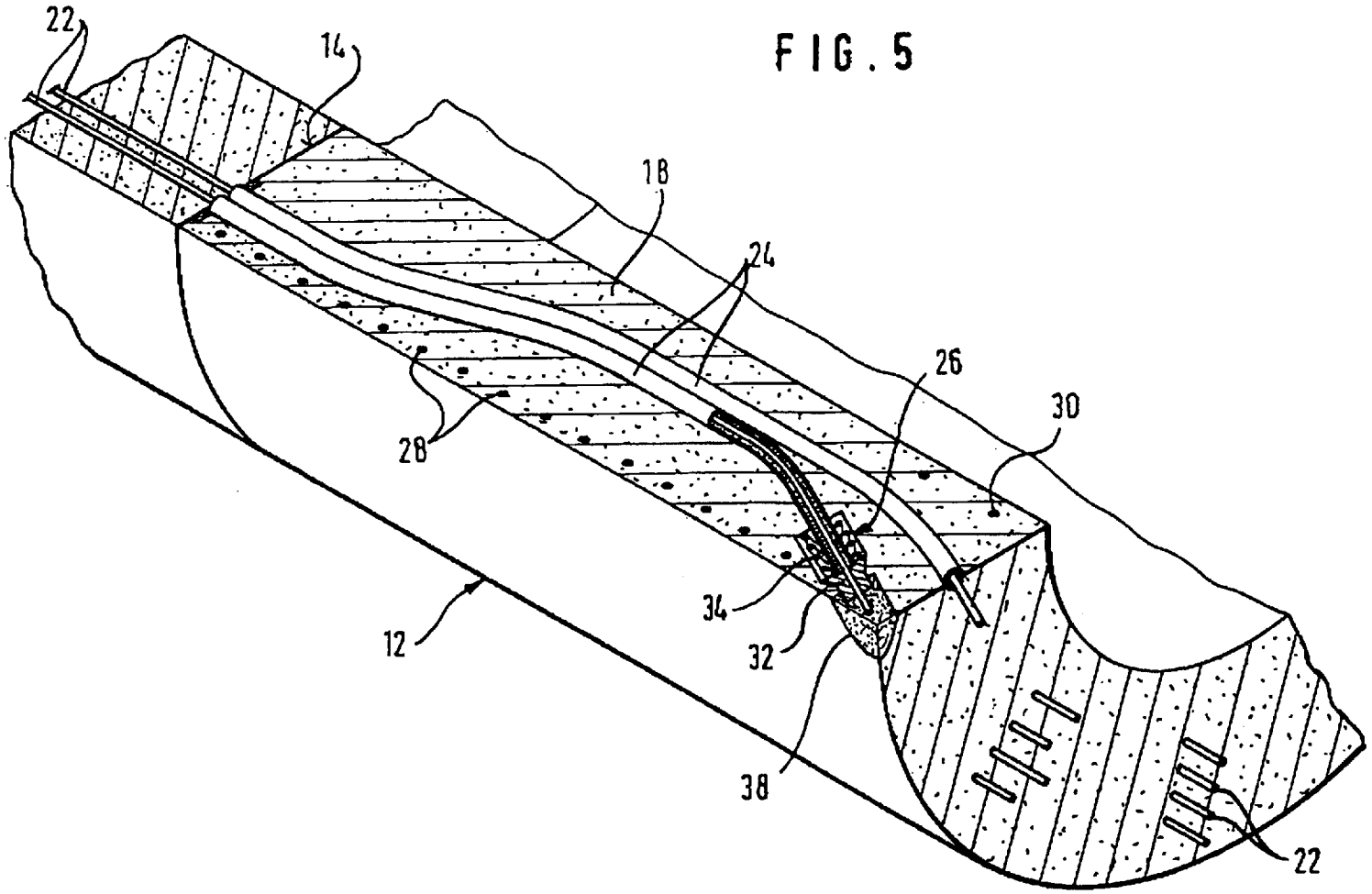

FIG. 3 a cross section through a jacket pipe layout with a first strand partially guided within a prestressed concrete pipe;

FIG. 4 a conventional connection of two prestressed concrete elements in the form of two prestressed concrete pipes; and FIG. 5 is a perspective view of the jacket pipe layout of FIG. 1.

FIG. 1 and 5 show a jacket pipe layout according to the invention. A partial section through the second prestressed concrete pipe, which is generally designated by reference number 12, is shown by way of the example of a prestressed concrete element. The second prestressed concrete pipe 12 is joined at end-face joint 14 to a first prestressed concrete pipe (not shown). Prestressed concrete pipe 12 is formed in a rotationally symmetrical manner around axis 16.

The second prestressing strands 22, which are cast into the second prestressed concrete pipe as early as during the production of the prestressed concrete pipe, run inside concrete wall 18 of second prestressed concrete pipe 12. As shown in FIG. 1, prestressing strands 22 are preferably arranged in a composite manner and shall be designated as second strands so as to emphasize the fact that they belong to the second prestressed concrete pipe 12. The second strands preferably run parallel to one another in an axial direction within wall 18 of second prestressed concrete pipe 12.

Because they are embedded into concrete wall 18, the second strands 22 are not fixed in special end anchors but run as far as end-face joint 14 or until just before end-face joint 14 where they terminate. The entire second prestressed concrete pipe 12 is therefore in a prestressed condition before it is installed. Alternatively, the second strands can also terminate in suitable anchors, for example in the form of wedge-type anchors, or the second strands guided until just before end-face joint 14 are protected from meteorological effects by applying a sealing material.

If a further, third prestressed concrete pipe (not shown) is to be joined to the second prestressed concrete pipe, the second strands have a projection above the second prestressed concrete pipe 12's end face opposite a third prestressed concrete pipe. The connection according to the invention is therefore achieved using any number of prestressed concrete pipes arranged side by side, whereby all those prestressed concrete pipes used can be produced so as to be identical to one another.

Jacket pipes 24, which help to accommodate the first strands emerging from the first prestressed concrete element (not shown), are molded within the second prestressed concrete pipe.

When producing the second prestressed concrete pipe, the jacket pipes 24 can be individually molded in the second prestressed concrete pipe, though they may also form part of a prefabricated attachment insert 26 comprising not only the jacket pipes 24 but also reinforcement spirals 28, radial bars 30 welded on to rings as well as end anchors 32 with snap rings 34. By using prefabricated attachment inserts 26, the stress analysis can, on the one hand, be made on the basis of a single example and transferred to all the prestressed concrete elements of a production series, while on the other hand, a simple, cost-effective and standardized production of geometrically identical, prestressed concrete elements can be performed.

The first strands emerging from the first prestressed concrete element run within jacket pipes 24 and terminate in end anchors 32 which are each accessible from the wall of the prestressed concrete element via a prestressing chamber 38. End anchors 32 can be designed in various ways, for example in the form of wedge-shaped anchors, as well as in the form of bolt connections by joining the first strands to a threaded pin on which a nut can be screwed.

Jacket pipes 24 preferably have a structured surface, for example in wavy a or corrugated form. This has the advantage that once a hardening material is injected into jacket pipes 24, this material hardens and forms a solid link between the first strand guided within the relevant jacket pipe and the jacket pipe. The jacket pipe's structured surface ensures that the tractive force passing in an axial direction of the first strand is transferred to the second prestressed concrete pipe without the risk of slippage between the jacket pipe and the surrounding concrete material of the second prestressed concrete pipe.

Snap rings 34 and radial bars 30 each help to increase the strength of the second prestressed concrete pipe 12 in the area of end anchors 32 as well as to absorb, perpendicular to the longitudinal axis of prestressed concrete pipe 12, the force components arising on account of the jacket pipes' bent trajectory as shown in FIG. 1.

A bent course of jacket pipes 24 within second prestressed concrete pipe 12 is due to the fact that end anchors 32 have to be reachable from a wall of the prestressed concrete pipe. The first strands introduced into the second prestressed concrete element have to be tensioned on account of the subsequently described method for joining two prestressed concrete elements, for which reason the ends of the first strands have to be accessible from the outside.

The course of the jacket pipes shown in FIG. 1 is purely by way of example, though it does depict a course in which small bending radii do not arise.

Figure 2:
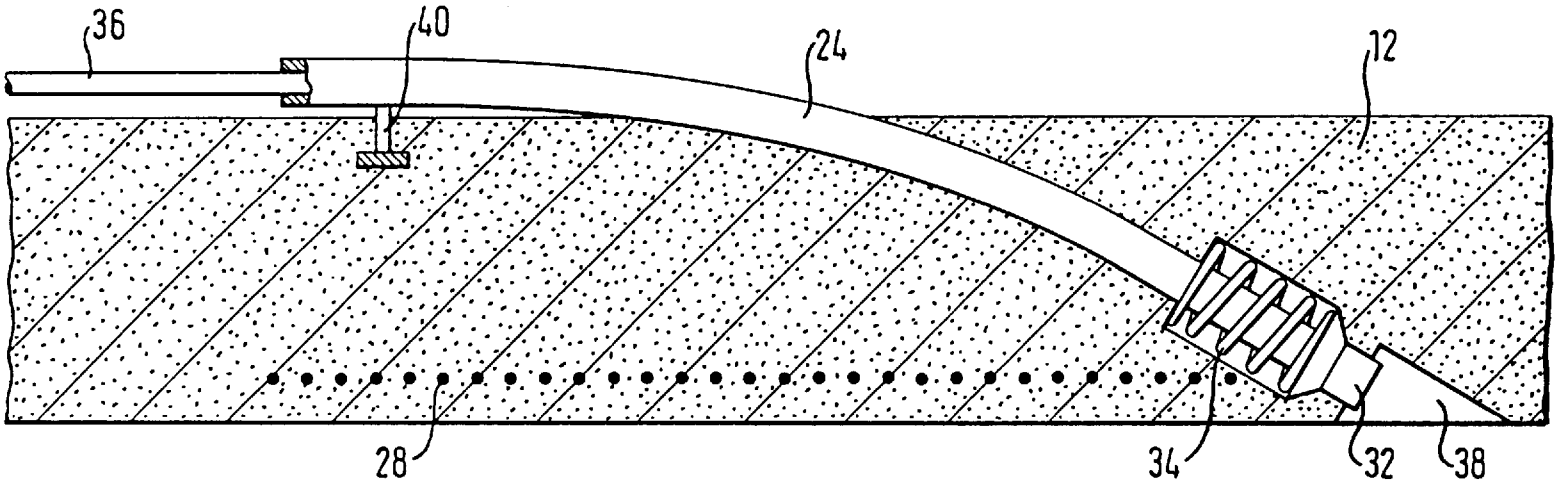
FIG. 2 shows a cross section through a jacket pipe layout with a first strand partially guided beyond the prestressed concrete element.

FIG. 2 represents a version of an embodiment in which a first strand 36 is partially guided beyond the second prestressed element 12.

This embodiment is particularly applied when prestressed concrete elements are to be joined together with a minimum thickness, for example prestressed concrete pipes with a low wall thickness. In this instance, it is recommended to guide the first strands partially beyond the concrete wall of the second prestressed concrete element because there is not enough space inside the wall of the second prestressed concrete pipe to guide jacket pipes 24 completely within the concrete wall in addition to guiding the second strands (not shown) and the other reinforcement elements in the form of reinforcement spiral 28, snap rings 34 or the radial bars shown by means of FIG. 1. Another reason why the jacket pipes are partially guided beyond the second prestressed concrete element is that very large curvature radii of the first strands can be achieved in this manner.

In order to protect the first strands 36 running outside the second prestressed concrete pipe from the effects of the weather, these strands are surrounded by a suitable jacket pipe 24 into which a suitable filling material, for example cement or lime milk, is injected.

The jacket pipe is preferably a steel pipe and can also be secured into position by a support ring 40 during its course beyond the wall of the second prestressed concrete element.

FIG. 3 shows an embodiment in which the first strand running within a second prestressed concrete pipe is passed through the inner shell of the second prestressed concrete pipe. In the embodiment shown in FIG. 3, the first strands emerge from and re-enter the inner wall of the prestressed concrete pipe at two diametrically arranged sites.

This embodiment is also preferably used when prestressed concrete elements, particularly prestressed concrete pipes with a small diameter, are joined together.

In area 42, which is exposed to the weather, of the first strands 36, these strands have to be protected from the effects of the weather. This may occur in the above described manner by guiding the first strands 36 in jacket pipes 24 and filling these jacket pipes by injecting a suitable filling material once the first strands have been tensioned. If the first strands in area 42 have a straight course, i.e. are not bent, a simple plastic, e.g. PVC, encasing of the first strands can satisfy this object.

A guidance of the first strands that differs from the embodiment shown in FIG. 3 is of course also conceivable in which the first strands likewise emerge from the inner surface of the second prestressed concrete pipe, though they re-enter the second prestressed concrete pipe at a site which is merely axially displaced from the outlet site.

The connection of two prestressed concrete elements according to the invention's method shall be described in the following.

The two prestressed concrete elements to be joined are arranged at a slight distance in relation to one another, with the abutting surfaces to be brought into contact facing one another.

The first strands emerging from the first prestressed concrete element with a predetermined projection are introduced into the inlet openings in the second prestressed concrete element corresponding to the respective outlet openings from the first prestressed concrete element and are introduced through the cavities, particularly in the form of jacket pipes, provided in the second prestressed concrete element, until they emerge from the second prestressed concrete element.

If the first strands have each emerged from the second prestressed concrete element, the two prestressed concrete elements to be joined are brought into contact with one another by means of the joint sides and the first strands are fixed within the second prestressed concrete element under conditions of tensile stress. The tensile stress is produced for example by the application of hydraulic presses which can apply a respectively defined tensile stress to the individual first strands. As a result, the two prestressed concrete elements to be joined are pressed firmly against one another and secured in this position. Before bracing the first strands, the joint sides of the prestressed concrete elements to be joined can be fitted with a suitable, sealing coat so as to prevent moisture penetrating into the connecting joint of the prestressed concrete elements to be joined together. The first strands are subsequently fixed in the second prestressed concrete element by means of suitable end anchors, as are known in engineering terms.

A filling material is then injected into the jacket pipes; this filling material is intended either to avoid just the corrosion on the first strands or is also intended to transfer the forces to the prestressed concrete element. In the first instance, a lubricant such as grease is preferably used, in the second instance, cement or a similar construction material is appropriate. Alternatively, a hardening artificial resin mixture can also be injected. If a filling material is used, by means of which the tensile stress forces in the first strand, in the form of pressure forces, can be transferred to the surrounding concrete material of the second prestressed concrete element, the end anchor can be designed to be weaker or can also be re-removed once the filling material has hardened. This is possible because the end anchor only has to absorb forces in its assembled state, but once the filling material has hardened, the forces are directly transferred from the first strands via the hardened filling material and the jacket pipes into the second prestressed concrete element.

The filling material is injected from the abutting surface between the first and second prestressed concrete element. The filling material is injected through preferably radially located feed ducts into the second prestressed concrete element and fills the cavities inside the jacket pipes until the filling material emerges at the end anchors. Annular grooves, in which the jacket pipes terminate, are preferably molded in the front end of the second prestressed concrete element so as to distribute the introduced filling material over the individual jacket pipes. Filling material is injected into the groove or grooves via one or more feed ducts, whereupon the filling material penetrates into the jacket pipes and fills the cavities therein.

The prestressing chambers are finally filled with a sealing material such as concrete. If two prestressed concrete pipes are to be joined, it is possible to use a preferably transparent sleeve, which can be moved axially along the prestressed concrete pipe's inner or outer radius and through which the filling material can be injected. The prestressing chambers and as an option—if the end anchors were previously removed—the additionally resultant adjacent cavities can thereby be filled in a rapid and convenient manner.

The prestressing chambers can also be conveniently filled by the fact that after it has emerged from the end anchors, the filling material injected into the jacket pipes is used to fill the prestressing chambers. It is also recommended here to use a preferably transparent sleeve which enables a flush sealing of the filled filling material with the outer surfaces of the second prestressed concrete element.

Even though the connection of prestressed concrete elements has been described by means of two components in the preceding description, any number of prestressed concrete elements can be joined together according to the invention. This is brought about by second strands being tensioned in a third prestressed concrete element, third elements being tensioned in a fourth prestressed concrete element etc.

The apparatus according to the invention has the major advantage that the flow of force continues in a direct manner from one prestressed concrete element into the adjacently erected, prestressed concrete element. No disruptive diversion of force is produced at the joint between the prestressed concrete elements to be joined; a flange that is perceived to be a visual defect and which is bolted or welded to the adjoining flange of the prestressed concrete element to be joined does not have to be used either.

Both the apparatus and the method according to the invention can be applied in all fields of structural engineering. Particular mention should be made of the construction of masts and towers in which prestressed concrete pipes, especially spun concrete pipes, can be joined together in the manner according to the invention.

Other applicational fields include bridge construction, since the method according to the invention can be used to erect the structure in a manner that is suspended without the provision of intricate bracing from a bridge foundation. Finally, the apparatus can be used to connect prefabricated prestressed concrete elements to foundation plates, it being possible to economize on materials during the casting of the foundation plates because the prestressed concrete elements secured thereto can be tensioned against the foundation plates at a high pressure and hence they are joined extremely securely to the foundation plate.

I claim:

1. A plurality of interconnectable prestressed concrete elements wherein a first prestressed concrete element and a second prestressed concrete element are capable of being connected;

wherein said first prestressed concrete element comprises:

at least a first joint face; and first prestressed strands extending within a wall of said first concrete element, each strand having an end portion emerging from said first concrete element in a direction toward said second prestressed concrete element;

wherein said second prestressed concrete element comprises:

at least a second joint face;

second prestressed strands extending within a wall of said second concrete element;

openings provided in said second concrete element; and fixing portions; and characterized in that said second strands run completely within the concrete wall of said second prestressed concrete element up to said second joint face or close to said second joint face.

2. A plurality of interconnectable prestressed concrete elements according to claim 1, characterized in that said openings in said second prestressed concrete element are formed by tubular cavities molded into said second prestressed concrete element.

3. A plurality of interconnectable prestressed concrete elements according to claim 2, characterized in that said tubular cavities are jacket pipes.

4. A plurality of interconnectable prestressed concrete elements according to claim 2, characterized in that, said tubular cavities have a bent trajectory.

5. A plurality of interconnectable prestressed concrete elements according to claim 2, characterized in that said tubular cavities, through which a first strand fixed under tensile stress passes, are filled with a filler.

6. A plurality of interconnectable prestressed concrete elements according to claim 5, characterized in that said filler is a lubricant.

7. A plurality of interconnectable prestressed concrete elements according to claim 5, characterized in that said filler is a hardening material such as cement or lime milk.

8. A plurality of interconnectable prestressed concrete elements according to claim 2, characterized in that said first and said second prestressed concrete elements comprise first and second prestressed concrete pipes, particularly first and second concrete pipes molded by centrifugal action.

9. A plurality of interconnectable prestressed concrete elements according to claim 8, characterized in that said tubular cavities run completely within the wall of said second prestressed concrete pipe.

10. A plurality of interconnectable prestressed concrete elements according to claim 8, characterized in that said tubular cavities run partially outside the wall of said second concrete pipe.

11. A plurality of interconnectable prestressed concrete elements according to claim 10, characterized in that said tubular cavities pass through an outer surface of said second prestressed concrete pipe.

12. A plurality of interconnectable prestressed concrete elements according to claim 10, characterized in that said tubular cavities pass through an inner surface of said second prestressed concrete pipe.

13. A plurality of interconnectable prestressed concrete elements according to claim 1, characterized in that said first strands each terminate in an end anchor.

14. A plurality of interconnectable prestressed concrete elements according to claim 3, characterized in that said end anchor is detachably mounted to said first strand.

15. A plurality of interconnectable prestressed concrete elements according to claim 13, characterized in that said end anchor is located within said second prestressed concrete element formed as a prestressed concrete pipe close to an inner wall of said second prestressed concrete pipe and is accessible through a prestressing chamber.

16. A plurality of interconnectable prestressed concrete elements according to claim 13, characterized in that a helical spring close to said end anchor is respectively arranged around said first strands.

* * * * *